US011391421B2

(12) United States Patent
Huang

(10) Patent No.: US 11,391,421 B2
(45) **Date of Patent: *Jul. 19, 2022**

(54) STRING LIGHTING AND METHODS OF ASSEMBLY

(71) Applicant: Lamues Light Enterprise Co., LTD, Phnom Penh (KH)

(72) Inventor: Kailang Huang, Dongguan (CN)

(73) Assignee: Lamues Light Enterprise Co., LTD, Phnom Penh (KH)

( * ) Notice: Subject to any disclaimer, the term of this patent is extended or adjusted under 35 U.S.C. 154(b) by 0 days.

This patent is subject to a terminal disclaimer.

(21) Appl. No.: 17/102,080

(22) Filed: Nov. 23, 2020

(65) Prior Publication Data

US 2021/0156530 A1 May 27, 2021

Related U.S. Application Data

(63) Continuation-in-part of application No. 16/909,487, filed on Jun. 23, 2020, now Pat. No. 11,073,261, and (Continued)

(51) Int. Cl.
*F21S 4/10* (2016.01)
*F21V 23/06* (2006.01)
(Continued)

(52) U.S. Cl.
CPC ..... *F21S 4/10* (2016.01); *F21V 1/00* (2013.01); *F21V 1/12* (2013.01); *F21V 3/00* (2013.01);
(Continued)

(58) Field of Classification Search
CPC ..... F21S 4/10; F21S 4/15; F21V 3/00; F21V 17/101; F21V 17/104; F21V 17/12;
(Continued)

(56) References Cited

U.S. PATENT DOCUMENTS 3,609,643 A 9/1971 Connan
4,667,276 A 5/1987 Cheng
(Continued)

FOREIGN PATENT DOCUMENTS

CN 105805618 7/2016
CN 106122821 11/2016
(Continued)

OTHER PUBLICATIONS

"Mini Glass No Flicker 3W Dimmable G9 LED Bulb COB SMD LED Light Crystal Chandelier LED Source Replace 30w Incandesent Lamps: No Flicker: Led Sourcecob Smd Led—AliExpress." Aliexpress.com, www.aliexpress.com/item/32810280460.html.

*Primary Examiner* — Alan B Cariaso

(74) *Attorney, Agent, or Firm* — Joseph A. Andelin; Fish IP Law, LLP

(57) ABSTRACT

A string light assembly having a plurality of light components is described. Each light component comprises a first cover, a second cover, and a collar for coupling the first and second covers together. When coupled, the first and second covers form a housing that has an interior space. The interior space is sized and dimensioned to house an electrical socket and a pair of electrical wires. The electrical socket electrically and removably couple with a light element such as an LED bulb. The light component also includes a lampshade that either removably couples with the collar or is integrally formed with the light element.

16 Claims, 15 Drawing Sheets

Related U.S. Application Data a continuation-in-part of application No. 16/691,298, filed on Nov. 21, 2019, now Pat. No. 10,883,709.

(51) Int. Cl.

| | |
|---|---|
| ***F21V 17/12*** | (2006.01) |
| ***F21V 17/10*** | (2006.01) |
| ***F21V 3/00*** | (2015.01) |
| ***F21V 17/00*** | (2006.01) |
| ***F21V 1/00*** | (2006.01) |
| ***F21V 1/12*** | (2006.01) |

(52) U.S. Cl.
CPC ..... *F21V 17/002* (2013.01); *F21V 17/101* (2013.01); *F21V 17/104* (2013.01); *F21V 17/12* (2013.01); *F21V 23/06* (2013.01)

(58) Field of Classification Search
CPC ..... F21V 23/06; F21V 1/12; F21V 17/002; F21V 1/00
See application file for complete search history.

(56) References Cited

U.S. PATENT DOCUMENTS

| | | | | |
|---|---|---|---|---|
| 5,649,763 | A | 7/1997 | Liou | |
| 6,371,629 | B1 * | 4/2002 | Martinez | F21S 4/10 362/248 |
| 6,758,578 | B1 | 7/2004 | Chou | |
| 7,666,036 | B1 * | 2/2010 | Zou | F21S 4/10 439/699.2 |
| 3,070,347 | A1 | 12/2011 | Lin | |
| 9,611,992 | B2 * | 4/2017 | Scales | H01R 33/94 |
| 9,752,763 | B2 | 9/2017 | Lin | |
| 9,784,442 | B2 | 10/2017 | Altamura | |
| 9,857,069 | B2 * | 1/2018 | Kim | F21V 29/74 |
| 9,900,968 | B2 | 2/2018 | Altamura | |
| 10,100,986 | B2 * | 10/2018 | Lin | F21S 4/10 |
| 10,295,129 | B2 | 5/2019 | McWhirter | |
| 10,309,591 | B2 | 6/2019 | Lan | |
| 10,393,351 | B2 | 8/2019 | Chen | |
| 10,422,486 | B2 | 9/2019 | Zhang | |
| 10,845,012 | B1 * | 11/2020 | Chung | F21S 4/10 |
| 10,883,709 | B1 * | 1/2021 | Huang | F21V 17/002 |
| 11,073,261 | B1 * | 7/2021 | Huang | F21V 23/002 |
| 2009/0251923 | A1 * | 10/2009 | Yu | F21V 31/005 362/653 |
| 2016/0215942 | A1 | 7/2016 | Hughes | |
| 2016/0230966 | A1 * | 8/2016 | DeFrancesco | F21V 3/02 |
| 2018/0340676 | A1 | 11/2018 | Tsai | |
| 2019/0338891 | A1 | 11/2019 | Heil | |

FOREIGN PATENT DOCUMENTS

| | | |
|---|---|---|
| CN | 205678443 | 11/2016 |
| CN | 304484212 | 5/2017 |
| CN | 107370003 | 11/2017 |
| CN | 206723917 | 12/2017 |
| CN | 206846401 | 1/2018 |
| CN | 1082241035 | 6/2018 |
| CN | 207716102 | 8/2018 |
| CN | 207893476 | 9/2018 |
| CN | 208222138 | 12/2018 |
| DE | 202017101703 | 5/2017 |
| EP | 3324100 | 5/2018 |
| WO | 2019090810 | 11/2017 |

* cited by examiner

STRING LIGHTING AND METHODS OF ASSEMBLY

This application is a continuation-in-part of and claims the benefit of priority of from U.S. patent application Ser. No. 16/909,487, filed on Jun. 23, 2020, and U.S. patent application Ser. No. 16/691,298, filed on Nov. 21, 2019, which are incorporated herein by reference in their entirety.

FIELD OF THE INVENTION

The field of the invention is lights, more specifically, string lighting and light components with removable light elements and lampshades, and methods of assembling light components.

BACKGROUND

The background description includes information that may be useful in understanding the present invention. It is not an admission that any of the information provided herein is prior art or relevant to the presently claimed invention, or that any publication specifically or implicitly referenced is prior art.

String lighting is a popular choice for both indoor and outdoor lighting and is also commonly used for seasonal decorating. Conventional string lighting assemblies typically comprise a main wired connection line that provides electrical current to a plurality of sockets and light components extending or hanging from the main line. One end of the string has an electrical plug that mates with, and receives electricity from, a power outlet. Optionally, the other end of the string can have another plug for providing power to another string.

Examples of different string light assemblies and light components can be found in U.S. Pat. Nos. 8,070,347, 9,752,763, U.S. Ser. Nos. 10/100,986, 10/309,591, 10/422,486, U.S. Pat. Publ. Nos. US20160215942 and US20180340676, and China Patent Nos. CN105805618B, CN106122821A, CN107370003A, CN108224135A, CN205678443U, CN206723917U, CN206846401U, CN207716102U, CN207893476U, CN208222138U, and CN304484212S. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

While various string light assemblies are known, there remains a need for a string light assembly that has fewer parts, is easier to assemble, and is more reliable than conventional string light designs. It would also be advantageous to provide a string light that has removable and interchangeable components such as lampshades to change and customize the appearance of the string light assembly.

SUMMARY OF THE INVENTION

The inventive subject matter provides apparatus, systems, and methods in which a string light assembly comprises a wired connection that has two ends. The first end has an electrical connector configured to electrically couple with an electrical power supply and the second end can optionally have an electrical connector configured to electrically couple with, and provide electricity to, another string light assembly. The wired connection comprises a plurality of light components extending therefrom at intervals located along a length of the wired connection. It is contemplated that the intervals can be regular (e.g., evenly spaced, repeat pattern spacing) or irregular (e.g., randomly spaced).

Each light component comprises two covers that join together and form a housing that has an interior space. A pair of electrical wires are sized and dimensioned to fit inside the interior space of the housing. The housing can comprise two arms extending from a body wherein each arm has an opening for receiving one of the wires. In this manner, the pair of electrical wires can pass through the interior space of the housing to provide electricity to the light element. In some embodiments, the housing can comprise a t-shaped body with two arms extending from the body in different directions and in alignment with one another (e.g., along the same line). However, it is also contemplated that the arms could extend from the body at different angles (e.g., not along the same line).

In some embodiments, the pair of electrical wires can connect with an electrical socket for receiving and removably coupling the light element. The electrical socket can have a cavity with an electrical connection for connecting a light element such as an LED bulb. When the electrical socket is placed inside the interior space of the housing, the cavity of the socket is accessible via an opening in the housing.

Each light component further comprises a collar sized and dimensioned to fit over a portion of the housing. In addition, a light element is configured to electrically and removably couple with the pair of electrical wires. The light element (also referred to as light source) is covered and/or protected by a first lampshade that either removably couples with the collar or is integrally formed with the light element.

Each light component can also include a second lampshade that has an opening sized and dimensioned to receive and fit over an external surface of the distal end of the housing, while at the same time the opening is smaller than an outer width of the collar. In this manner, the collar can be used to removably secure the second lampshade to the housing by first inserting the distal end of the housing through the opening of the second lampshade, and then securing the collar to the external surface of the distal end of housing. In some embodiments, the collar has internal threads that are configured to mate with external threads on the housing. However, it is also contemplated that non-threaded fasteners, such as press-fit (e.g., tapered surfaces), snap-fit (e.g., latching elements), male/female engagements, and magnetic fasteners can be used in a manner that is consistent with the inventive principles disclosed herein.

In yet other embodiments, the first lampshade can have external threads that mate with the internal threads on the collar. In this embodiment, the internal threads are long enough such that one end of the collar can be used to engage the housing while the other end of the collar can be used to engage the first lampshade.

In other aspects, the first and second covers that form the housing can each comprise a half-shell of the housing. It is also contemplated that the first cover and second cover can comprise either symmetrical or non-symmetrical portions of the housing.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIG. 2 is a perspective view of the string light assembly of FIG. 1 with the lights turned on.

FIG. 5 is a perspective view of the string light assembly of FIG. 4 with the lights turned on.

DETAILED DESCRIPTION OF THE INVENTION

The following discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

Figure 1:
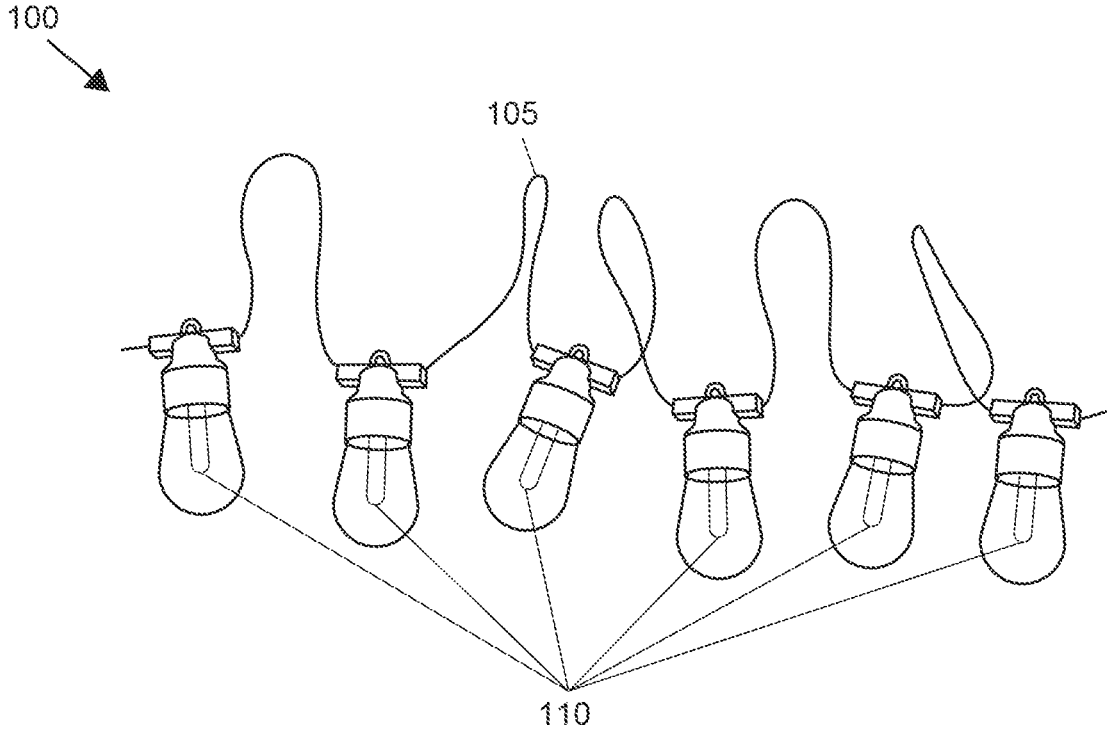
FIG. 1 is a perspective view of a string light assembly.
Figure 2:
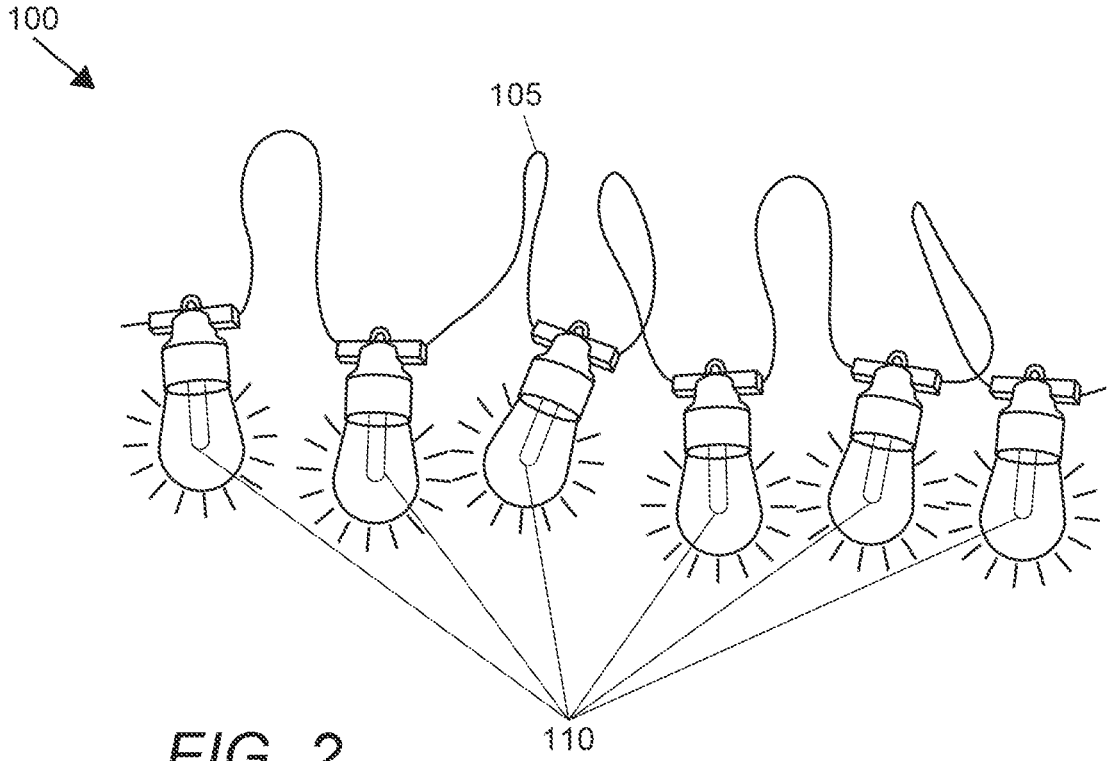

FIG. 1 shows a string light assembly 100 that has a plurality of light components 110 electrically coupled via wired connection 105. A first end of wired connection 105 can comprise an electrical plug (not shown) configured to couple with a power source to provide electricity to the lights 110 for illumination. FIG. 2 shows string light assembly 100 with the light components 110 turned on. A second end of wired connection 105 can include an electrical plug (not shown) configured to couple with, and provide electricity to, an end of another string light assembly.

Figure 3:
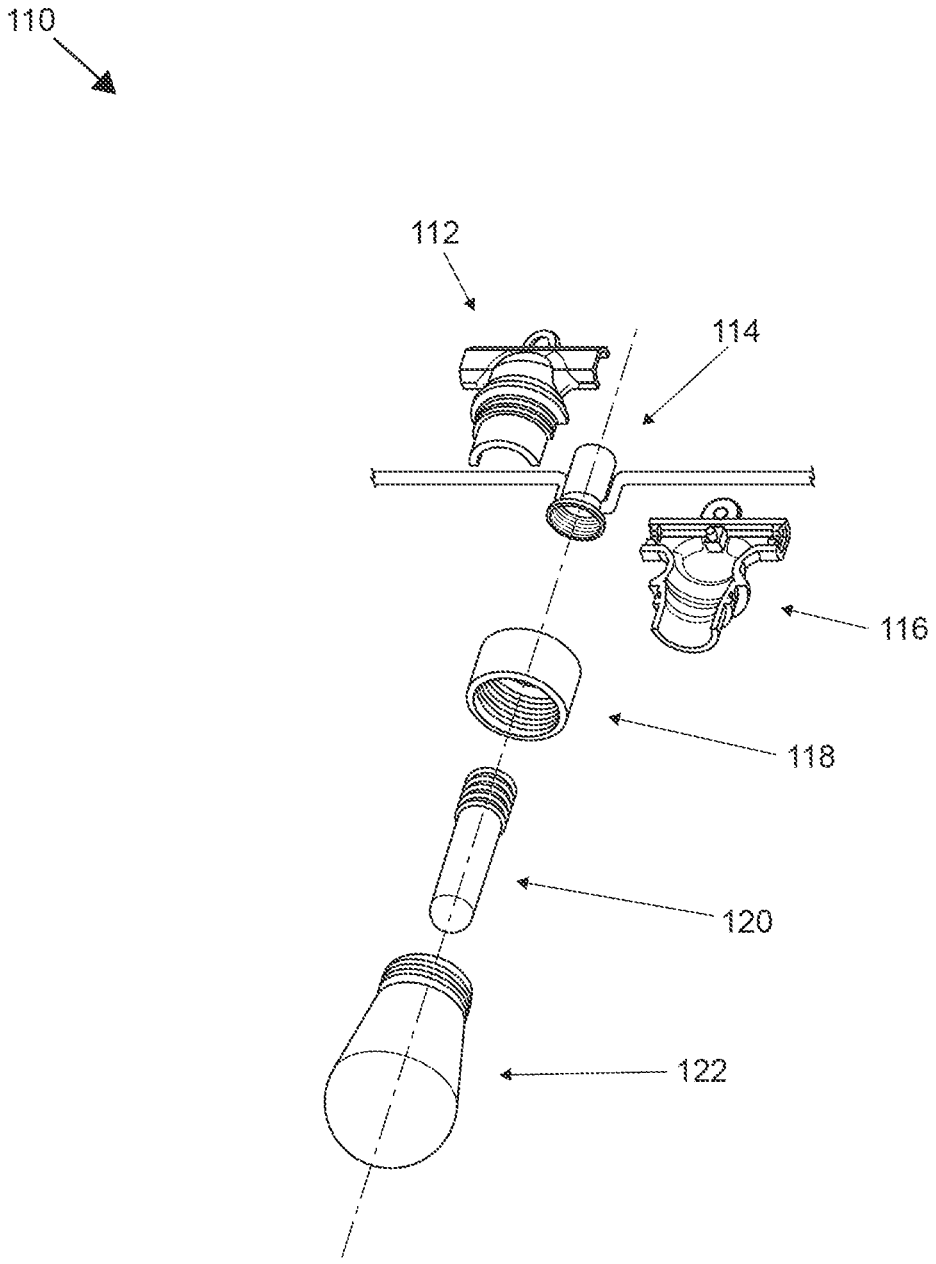
FIG. 3 is an exploded view of a light component of FIG. 1.

FIG. 3 shows an exploded view of a light component 110. Light component 110 comprises a first socket cover 112 and a second socket cover 116 that couple together to form a socket housing with an interior space. The interior space is sized and dimensioned to enclose an electrical socket 114. First socket cover 112 and second socket cover 116 can be coupled together by screwing the threaded collar 118 onto the external threads of first socket cover 112 and second socket cover 116. It is also contemplated that collar 118 could employ non-threaded fasteners to secure first socket cover 112 and second socket cover 116 together, including male-female engaging connectors, press-fit connections (e.g., tapered surfaces), snap-in connections (e.g., latching elements), and magnetic fasteners.

First socket cover 112 and second socket cover 116 can be made of plastic, metal, a composite, or any other material suitable for housing an electrical socket and light element. When coupled, first socket cover 112 and second socket cover 116 form a t-shaped housing with two arms extending in different directions. The arms also have openings on their respective ends that allow the two wired connections of socket 114 to pass therethrough.

Socket 114 can be any suitable electrical socket such as parallel XTW or SPT for #20 AWG light string with E12 socket or E17 socket, or parallel XTW or SPT for #18 AWG light string with E17 socket. Socket 114 has a threaded cavity with electrical connections for supplying power to a light element 120. Light element 120 can be any suitable light source, such as E12/E17 incandescent bulbs or LED bulbs. Light element 120 has external threads that mate with the threads of the cavity of socket 114. However, it is also contemplated that light element 120 can removably couple with socket 114 using other known fasteners, including male-female engaging connectors, press-fit or snap-in connections, and magnetic fasteners.

Light component 110 also comprises a lamp shade 122 that removably couples with collar 118 via external threads that mate with the internal threads of collar 118. However, it is contemplated that light component 110 could also be removably coupled with collar 118 using other fasteners. Lampshade 122 has an interior space that is sized and dimensioned to house light element 120 for protection. Lampshade 122 can be made of plastic, metal, or any suitable material for protecting light element 120. Lampshade 122 can also be made of different colors and/or levels of translucency to produce different lighting.

Figure 4:
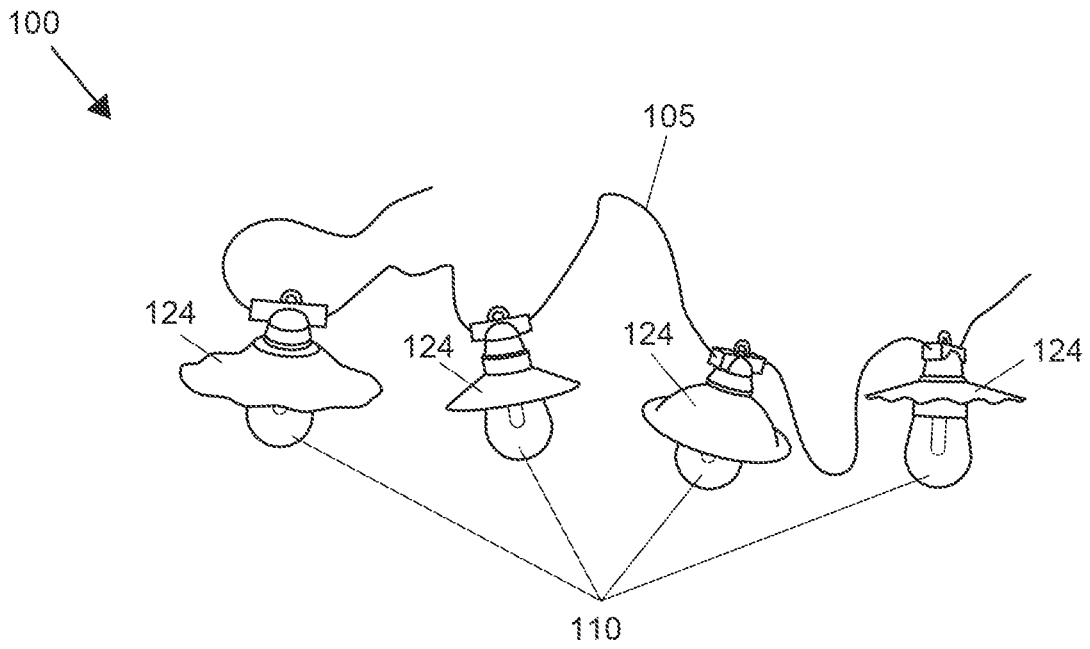
FIG. 4 is a perspective view of the string light assembly of FIG. 1 with a second lampshade.
Figure 5:
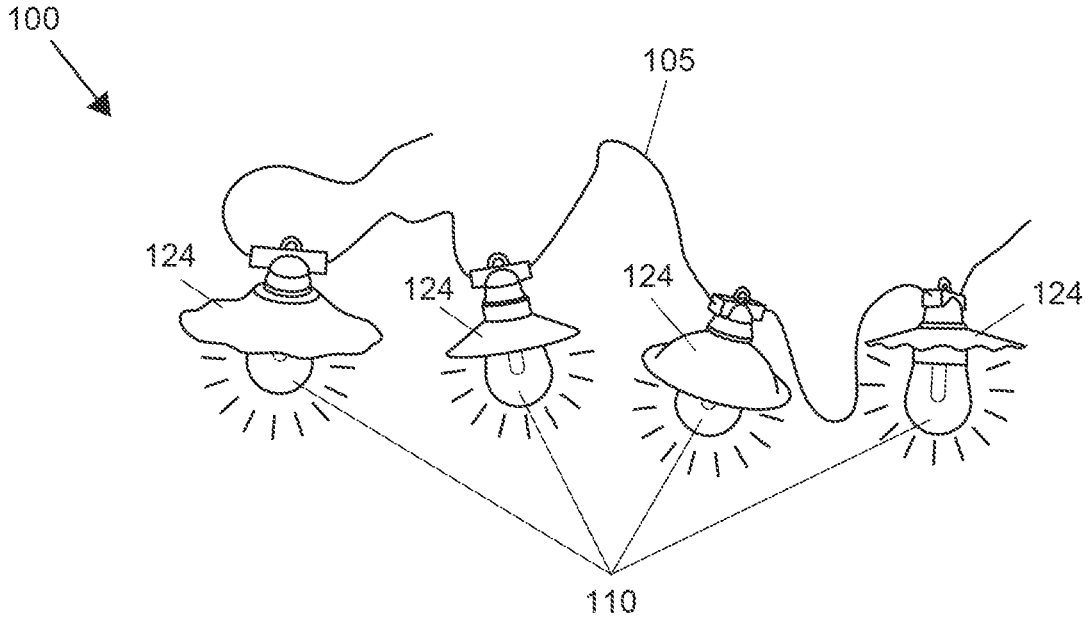

FIG. 4 shows string light assembly 100 with a secondary lampshade 124 removably attached to each light component 110. FIG. 5 shows the string light assembly 100 and secondary lampshade 124 with the lights turned on by a power supply (not shown).

Figure 6:
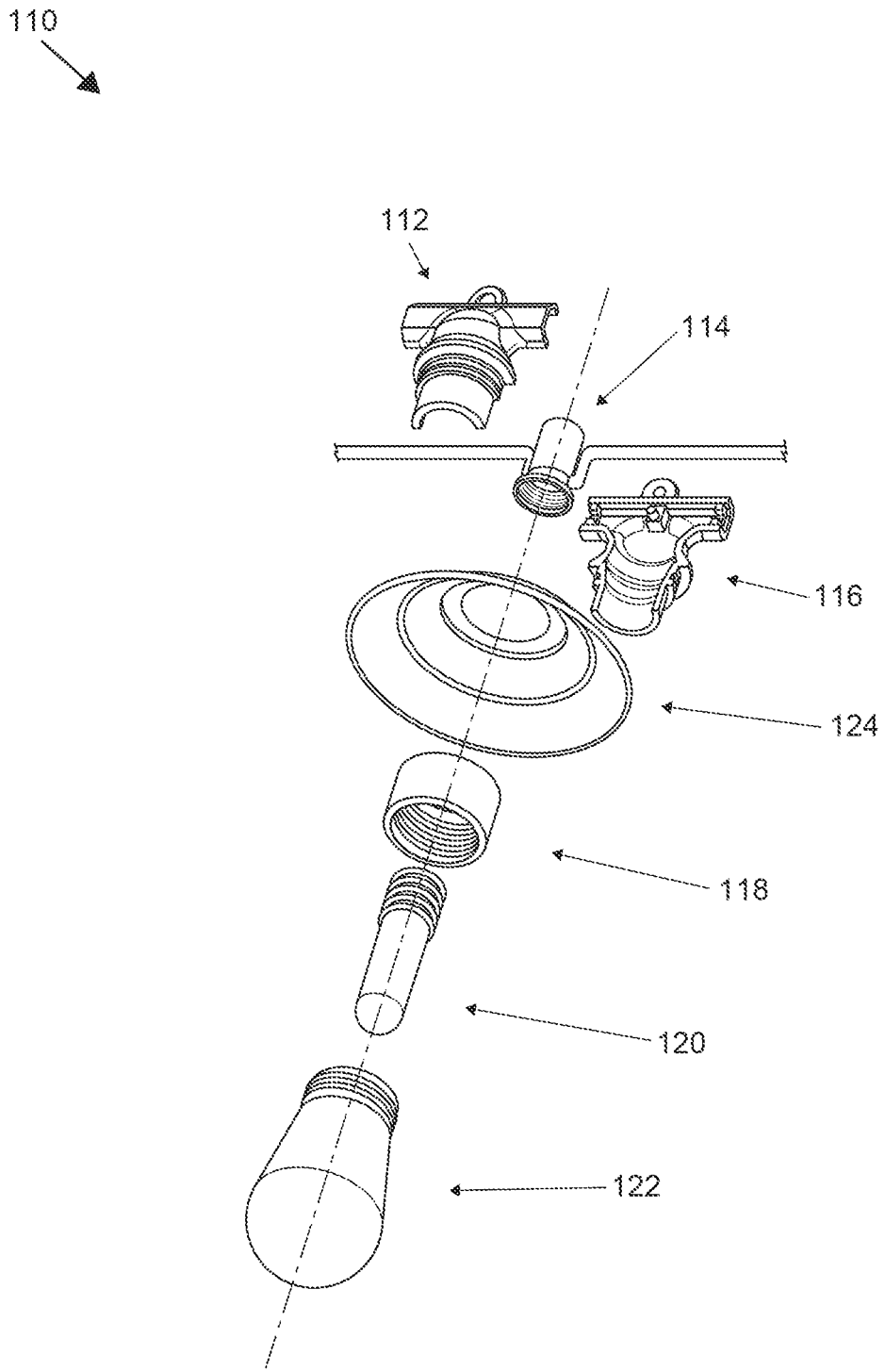
FIG. 6 is an exploded view of the light component of FIG. 4 with a second lampshade.

FIG. 6 shows an exploded view of string light 100 with the secondary lampshade 124. The parts shown in FIG. 6 are the same as FIG. 3 except for the addition of the secondary lampshade 124. Lampshade 124 removably couples with the first socket cover 112 and the second socket cover 116 by placing the distal end of the t-shaped body through the opening of lampshade 124 and then screwing collar 118 onto the external threads of first socket cover 112 and the second socket cover 116. The size of the opening of lampshade 124 is less than an outer width or diameter of the collar and a rim or annular flange on the housing. In this manner, fastening the collar 118 onto the housing will press and secure lampshade 124 to the housing.

It is contemplated that lampshade 124 can be made of plastic, metal, a composite, or any material suitable for providing shading to a light element. It is also contemplated that lampshade 124 can be made in many different shapes to provide different styles (e.g., outdoor, indoor, modern, rustic, etc.) and can be interchangeable with different shapes and colors of lampshades to create a different style for the string light assembly. It is also contemplated that lampshade 122 and light element 120 can be interchangeable with other lampshades and light elements, respectively, to provide different shapes, colors, and light types (e.g., LED vs incandescent, 60 watts vs 100 watts, etc.).

The light component design described herein advantageously allows for different lampshades and light elements to be interchangeable to customize the look and feel of the string light assembly. Additionally, the light component design is easy to assemble due to a reduced number of parts. The design can also be used to imitate the effect of an E26 string light, but with the lower cost due to use of an LED bulb.

Figure 7:
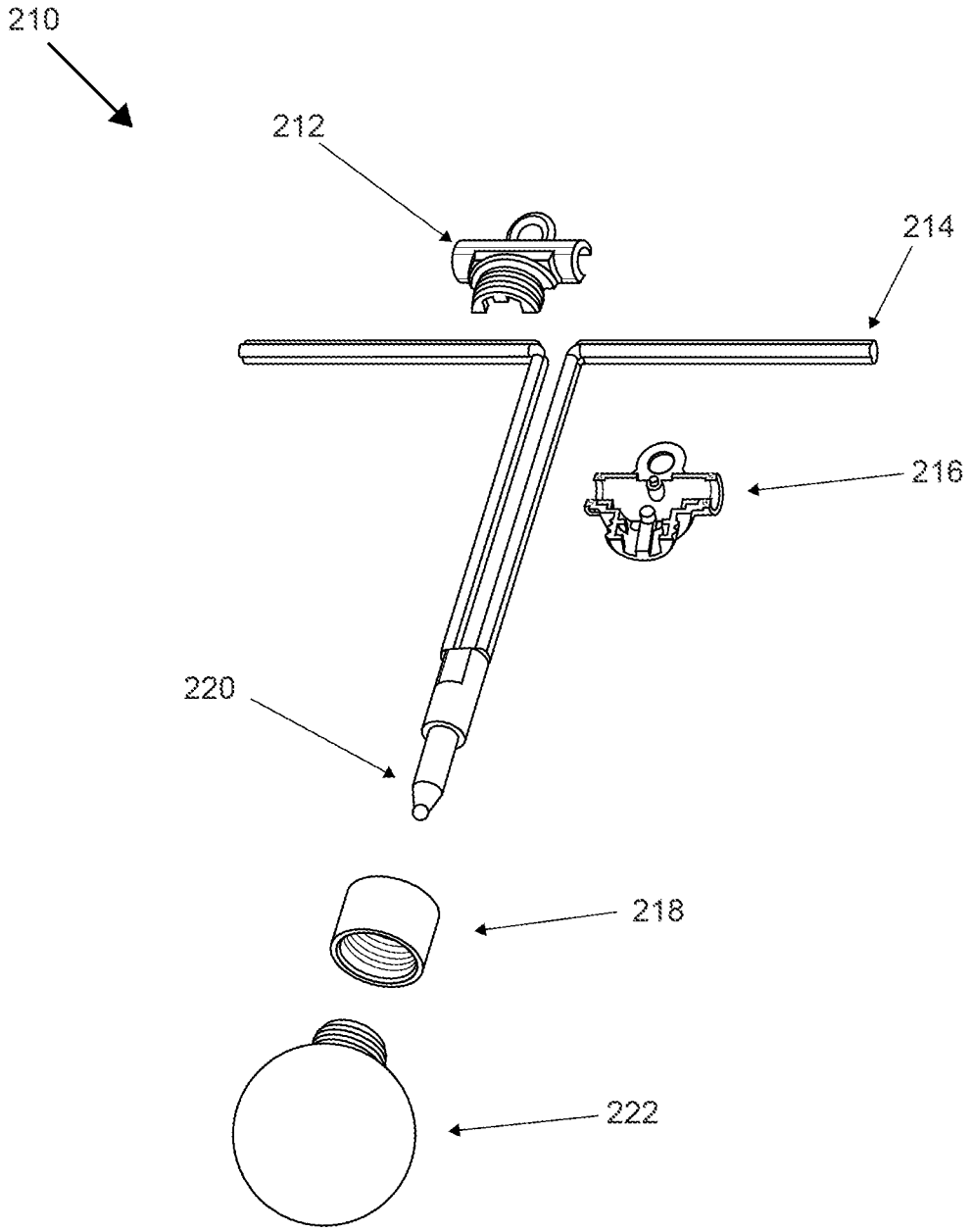
FIG. 7 is an exploded view of another embodiment of a light component.

FIG. 7 shows an exploded view of a light component 210. Light component 210 comprises a first cover 212 and a second cover 216 that couple together to form a housing with an interior space. The interior space is sized and dimensioned to enclose a pair of electrical wires 214. First cover 212 and second cover 216 can be coupled together by screwing the threaded collar 218 onto the external threads of first cover 212 and second cover 216. It is also contemplated that collar 218 could employ non-threaded fasteners to secure first cover 212 and second cover 216 together, including male-female engaging connectors, press-fit or snap-in connections, and magnetic fasteners.

First cover 212 and second cover 216 can be made of plastic, metal, a composite, or any other material suitable for housing a pair of electrical wires. When coupled, first cover 212 and second cover 216 form a t-shaped housing with two arms extending in different directions. The arms also have openings on their respective ends that allow the pair of electrical wires 214 to pass therethrough.

Pair of electrical wires 214 can be any suitable electrical wiring, including #22 AWG, #20 AWG, and #24 AWG light string. Pair of electrical wires 214 can be suitable light string for an incandescent light bulb or a light emitting diode (LED) bulb. Pair of electrical wires 214 supply power to a light element 220. Light element 220 can be any suitable light source, such as E12/E17 incandescent bulbs or LED bulbs. Light element 220 can be either permanently or removably coupled with pair of electrical wires 214. In some embodiments, light element 220 can be removably coupled with the pair of electrical wires 214 via a threaded coupling, male-female engaging connectors, press-fit or snap-in connections, magnetic fasteners, or any other suitable fastening means.

Light component 210 also comprises a lamp shade 222 that removably couples with collar 218 via external threads that mate with the internal threads of collar 218. However, it is contemplated that light component 210 could also be removably coupled with collar 218 using other fasteners. Lampshade 222 has an interior space that is sized and dimensioned to house light element 220 for protection. Lampshade 222 can be made of plastic, metal, or any suitable material for protecting light element 220. Lampshade 222 can also be made of different colors and/or levels of translucency to produce different lighting.

Figure 8:
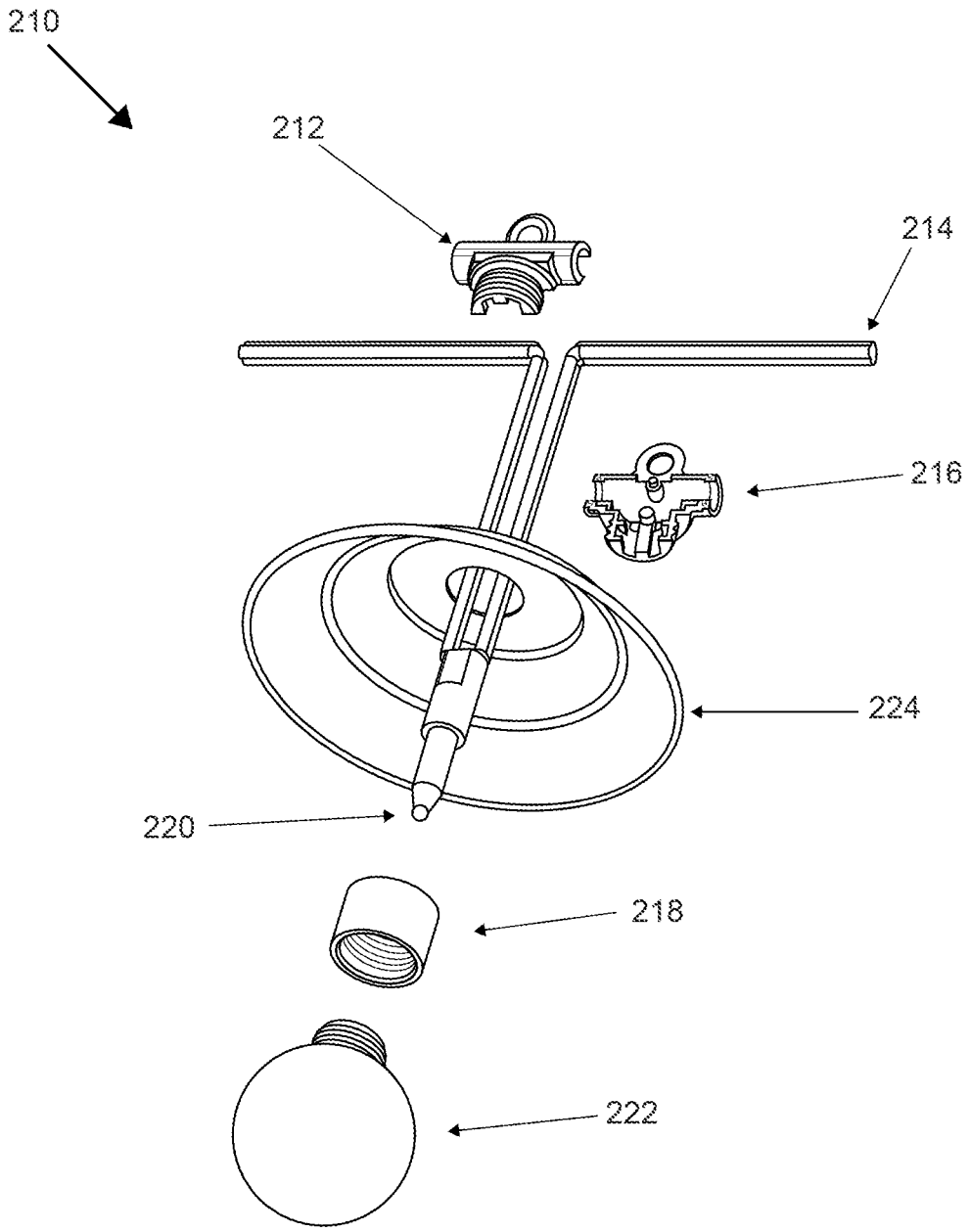
FIG. 8 is an exploded view of the light component of FIG. 7 with a second lampshade.

FIG. 8 shows an exploded view of string light 210 with the secondary lampshade 224. The parts shown in FIG. 7 are the same as FIG. 8 except for the addition of the secondary lampshade 224. Lampshade 224 removably couples with the first cover 212 and the second cover 216 by placing the distal end of the t-shaped body through the opening of lampshade 224 and then screwing collar 218 onto the external threads of first cover 212 and the second cover 216. The size of the opening of lampshade 224 is less than an outer width or diameter of the housing (e.g., rim or flange) and the collar. In this manner, collar 218 can be used to secure lampshade 224 to the housing formed by first cover 212 and second cover 216.

It is contemplated that lampshade 224 can be made of plastic, metal, a composite, or any material suitable for providing shading to a light element. It is also contemplated that lampshade 224 can be made in many different shapes to provide different styles (e.g., outdoor, indoor, modern, rustic, etc.) and can be interchangeable with different shapes and colors of lampshades to create a different style for the string light assembly.

Figure 9:
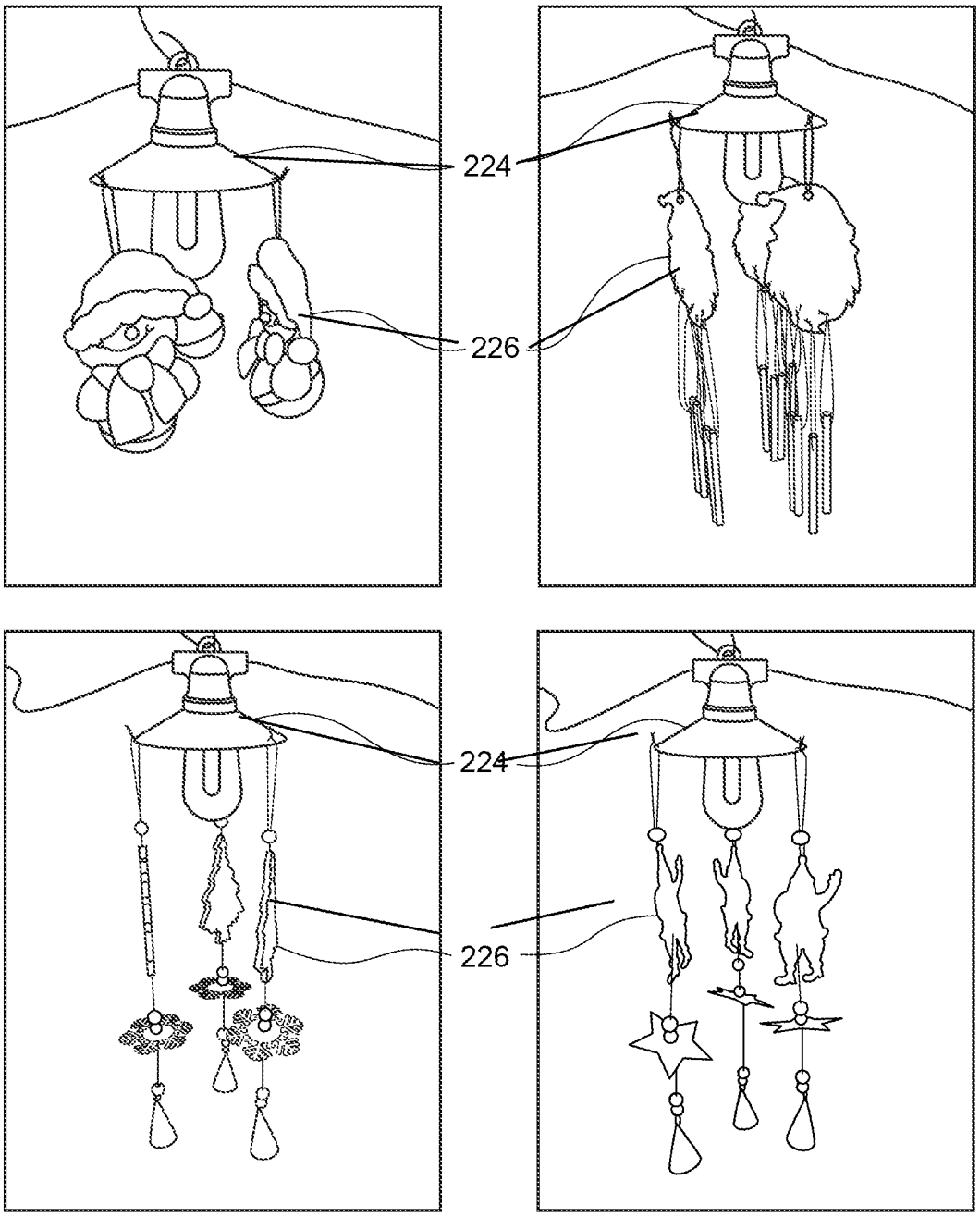
FIG. 9 are several perspective views of different ornaments hanging from the light component of FIG. 1.

FIG. 9 shows different decorative ornaments 226 hanging from lampshade 224 for creating a special or unique atmosphere. The ornaments 226 can be a wind chime, an object that casts a shadow, or a decorative item. Lampshade 224 can have one or more holes near a circumferential edge to allow for attachment of a string or other fastener for hanging decorative ornaments 226. Other fastener mechanisms are contemplated, including adhesives, clips, magnets, screws, or any other fastener suitable for attaching and hanging a decorative item.

Figure 10:
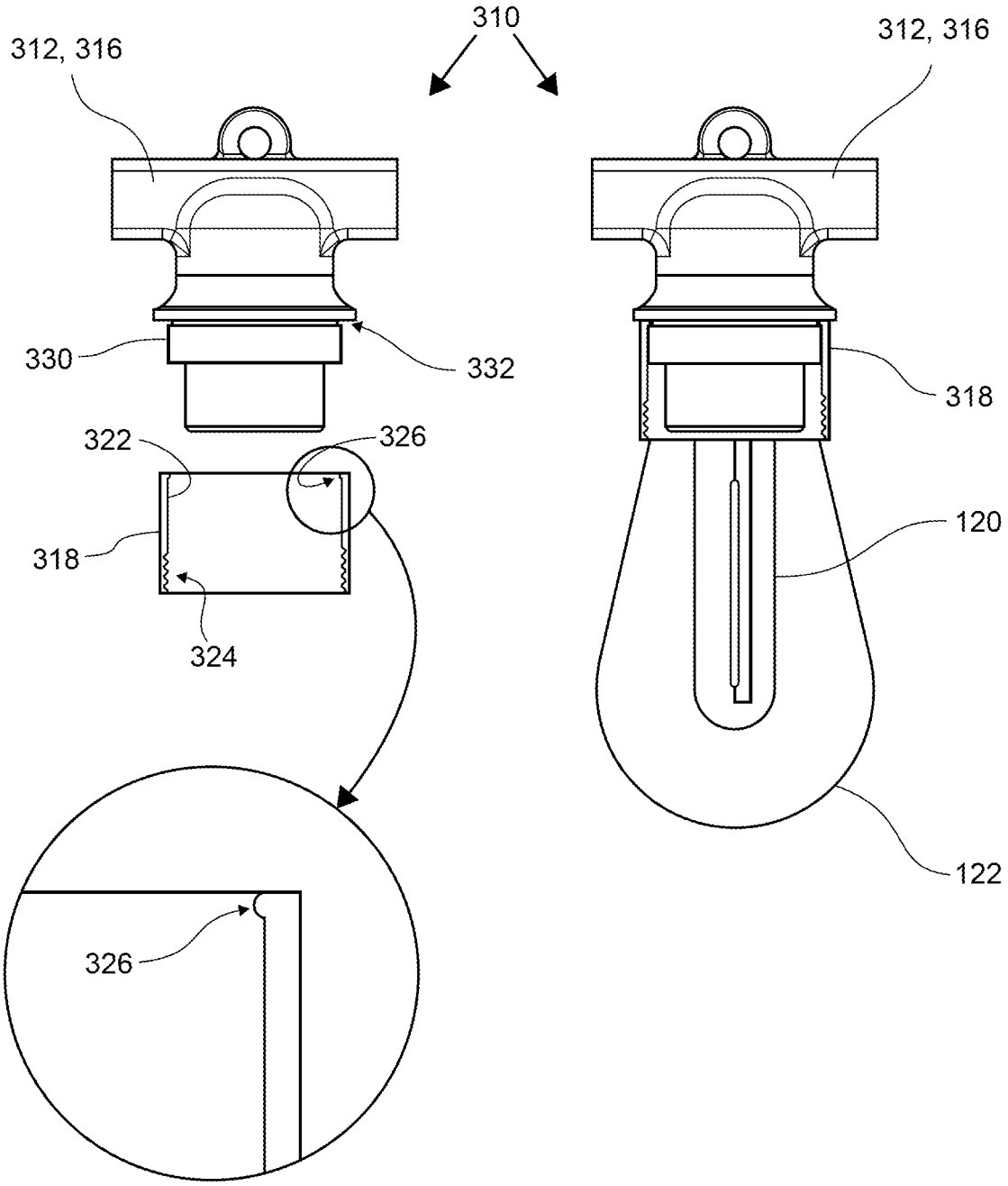
FIG. 10 is a side view of another embodiment of a light component with a latching collar.

FIG. 10 shows a side view of a light component 310. Light component 310 has a socket housing comprising a first socket cover 312 and a second socket cover 316. First socket cover 312 and second socket cover 316 are similar to socket cover 112 and socket cover 116 except for the non-threaded portion 330 and the annular groove 332. Light component 310 also comprises a collar 318, which has a threaded end 324 and a non-threaded end 322. Threaded end 324 has internal threads that mate with a first lampshade 122. Non-threaded end 322 has an internal annular flange 326 that is sized and dimensioned to press-fit with, and/or latch onto, annular groove 332. Collar 318 can also be made of a material that has sufficient flexibility to allow annulate flange 326 to unlatch from annular groove 332. Light component 310 also has a light element 120 that removably mates with an electrical socket 114 (not shown) disposed inside the socket housing (i.e., first socket cover 312 and second socket cover 316).

Figure 11:
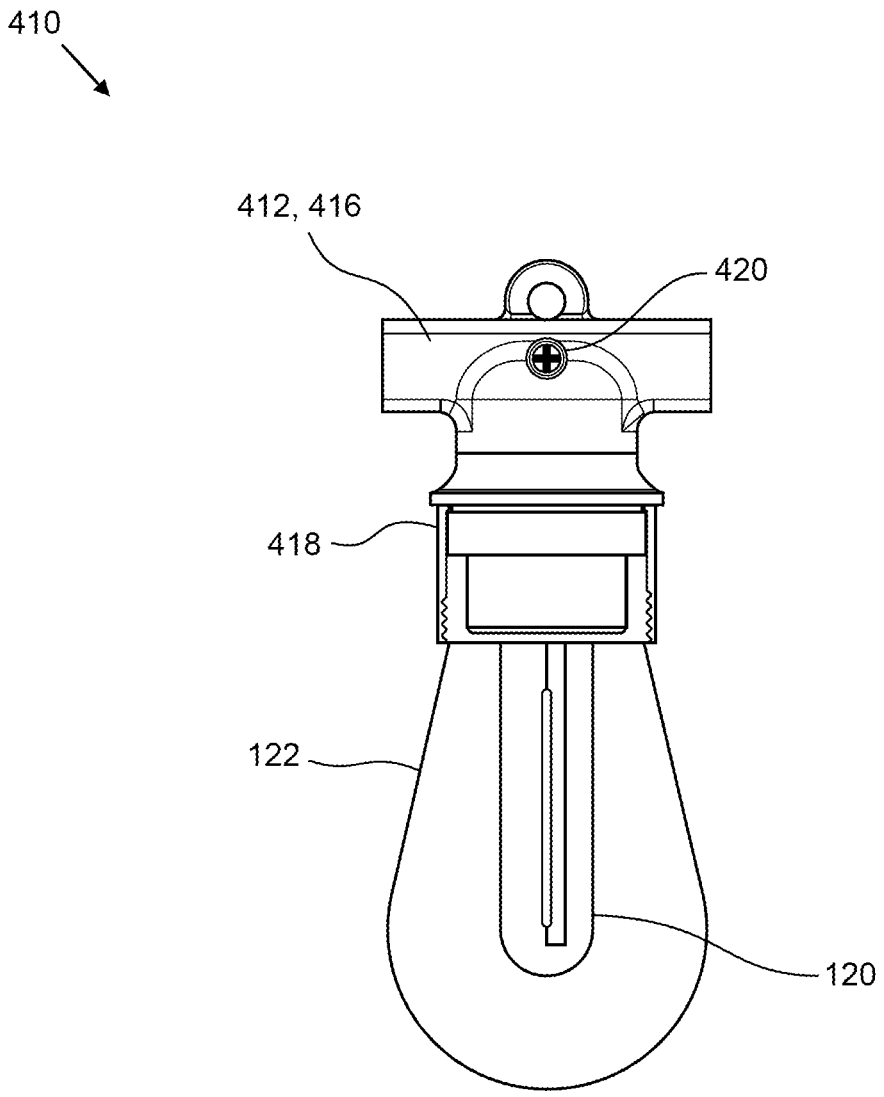
FIG. 11 is a side view of another embodiment of a light component with a screw hole in the housing.

FIG. 11 shows a side view of a light component 410. Light component 410 has a socket housing comprising a first socket cover 412 and a second socket cover 416. First socket cover 412 and a second socket cover 416 are similar to socket cover 112 and socket cover 116 except for a non-threaded portion and a screw hole 420. A screw passes through screw hole 420 in first socket cover 412 and second socket cover 416 to hold them together. Collar 418 has a non-threaded end that is sized and dimensioned to fit over the non-threaded portion of first socket cover 412 and second socket cover 416. Collar 418 also has a threaded end that mates with lampshade 122. Light element 120 removably couples with electric socket 114 (not shown) disposed inside the socket housing (i.e., first socket cover 412 and second socket cover 416).

Figure 12:
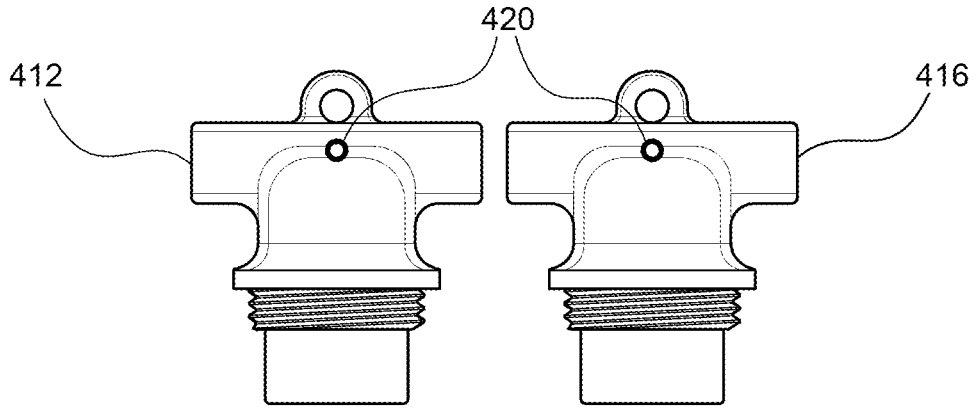
FIG. 12 is a side view of the first cover and second cover of the socket housing of FIG. 11.
Figure 13:
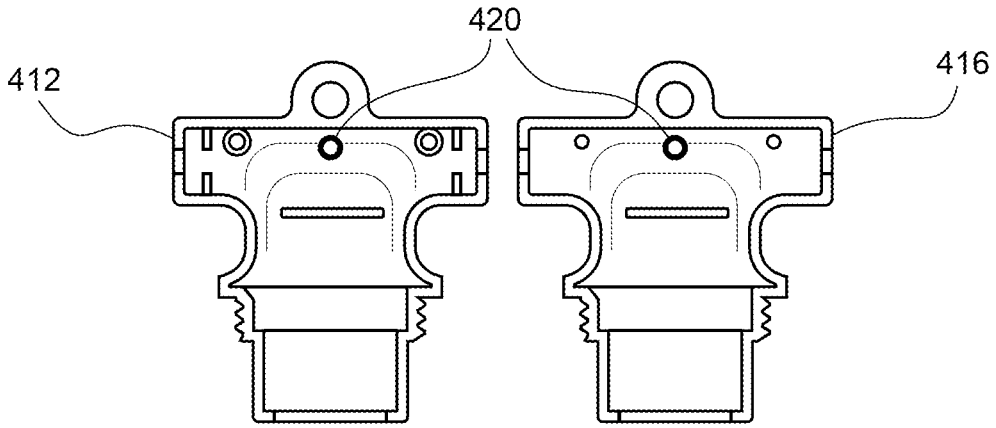
FIG. 13 is a side view of the inside of the first cover and second cover of FIG. 12.

FIG. 12 shows first socket cover 412 and second socket cover 416 decoupled and screw hole 420 passing through each part. FIG. 13 shows the inside of first socket cover 412 and second socket cover 416 with screw hole 420 and screw hole 420 passing through each part.

Figure 14:
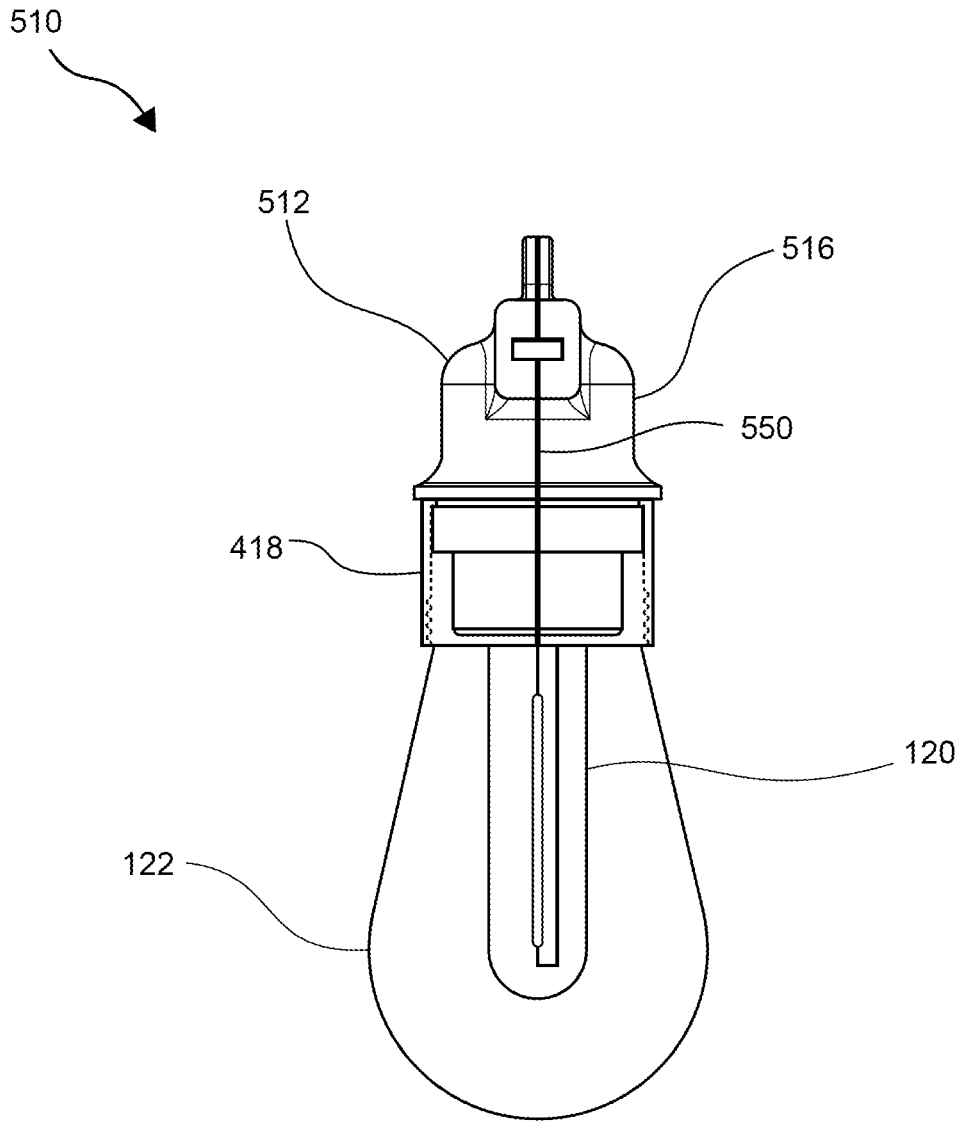
FIG. 14 is a side view of another embodiment of a light component with an ultrasonic weld.

FIG. 14 shows a side view of a light component 510. Light component 510 has a socket housing comprising a first socket cover 512 and a second socket cover 516. First socket cover 512 and second socket cover 516 are similar to socket cover 112 and socket cover 116 except for a non-threaded portion and an ultrasonic weld 550 that permanently joins them together. The weld is formed by applying high-frequency ultrasonic acoustic vibrations to the seam between the parts while holding the parts together under pressure. The vibrations create sufficient heat to form a solid-state weld between the parts. The parts can be made of either plastic or metal. In this manner, first socket cover 512 and second socket cover 516 are joined together permanently without the need for a screw and screw hole or external threads that mate with a threaded end of a collar.

Figure 15:
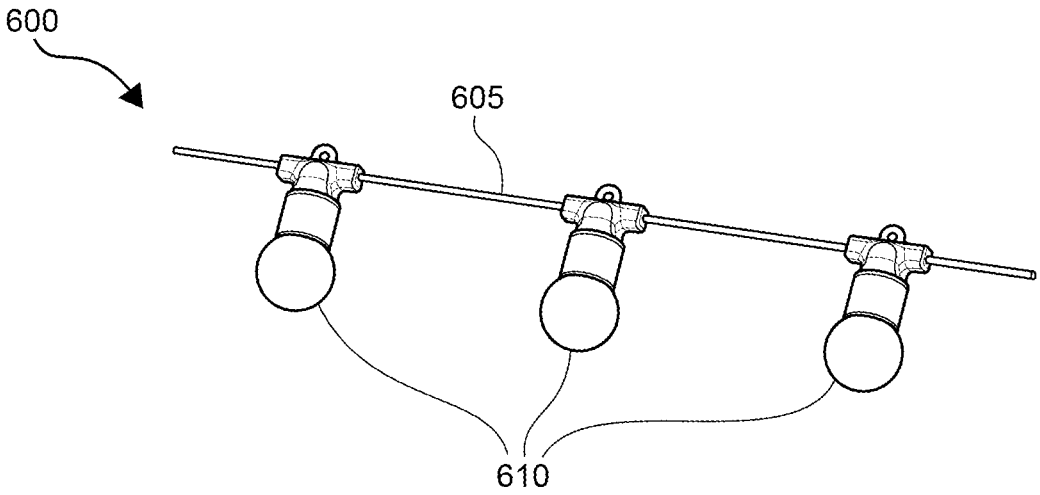
FIG. 15 is a perspective view of another embodiment of a string light assembly.

FIG. 15 shows a perspective view of a string light assembly 600 that has a plurality of light components 610 electrically coupled via wired connection 605. A first end of wired connection 605 (not shown) can comprise an electrical plug configured to couple with a power source to provide electricity to the lights 610 for illumination.

Figure 16:
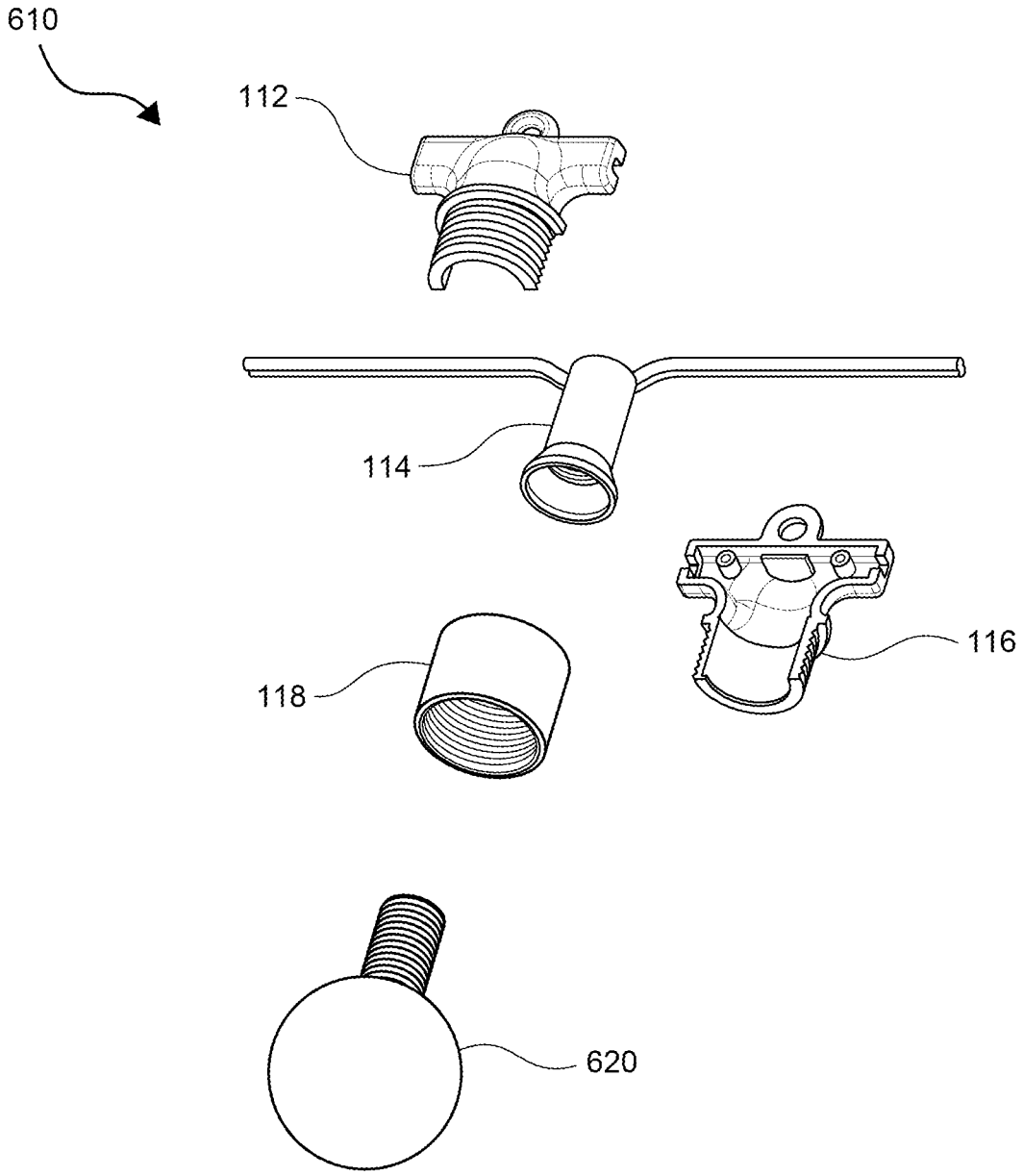
FIG. 16 is an exploded view of a light component of FIG. 15.

FIG. 16 shows an exploded view of light component 610. Light component 610 comprises a first socket cover 112 and a second socket cover 116 that couple together to form a socket housing with an interior space. The interior space is sized and dimensioned to enclose an electrical socket 114. First socket cover 112 and second socket cover 116 can be coupled together by screwing the threaded collar 118 onto the external threads of first socket cover 112 and second socket cover 116. It is also contemplated that collar 118 could employ non-threaded fasteners to secure first socket cover 112 and second socket cover 116 together, including male-female engaging connectors, press-fit or snap-in connections, and magnetic fasteners.

First socket cover 112 and second socket cover 116 can be made of plastic, metal, a composite, or any other material suitable for housing an electrical socket and light element. When coupled, first socket cover 112 and second socket cover 116 form a t-shaped housing with two arms extending in different directions. The arms also have openings on their respective ends that allow the two wired connections of socket 114 to pass therethrough.

Socket 114 can be any suitable electrical socket such as parallel XTW or SPT for #20 AWG light string with E12 socket or E17 socket, or parallel XTW or SPT for #18 AWG light string with E17 socket. Socket 114 has a threaded cavity with electrical connections for supplying power to a light element 620. Light element 620 comprises a suitable light source, such as E12/E17 incandescent bulbs or LED bulbs, surrounded by an outer lampshade. Unlike the light component 110 and lampshade 122 in FIG. 3, light element 620 has a lampshade and light source that are unitary. The outer lampshade layer can be made of plastic, metal, or any suitable material for protecting the light source and/or diffusing light. The outer lampshade layer can also be made of different colors and/or levels of translucency to produce different lighting.

Light element 620 has external threads that mate with the threads of the cavity of socket 114. However, it is also contemplated that light element 620 can removably couple with socket 114 using other known fasteners, including male-female engaging connectors, press-fit or snap-in connections, and magnetic fasteners. Since the lampshade layer of light element 620 is integral with the light source, collar 118 does not need internal threads on its distal end for coupling a lampshade. Thus, in alternative embodiments, collar 118 of light component 610 can be modified to have a threaded end and a non-threaded end.

Figure 17:
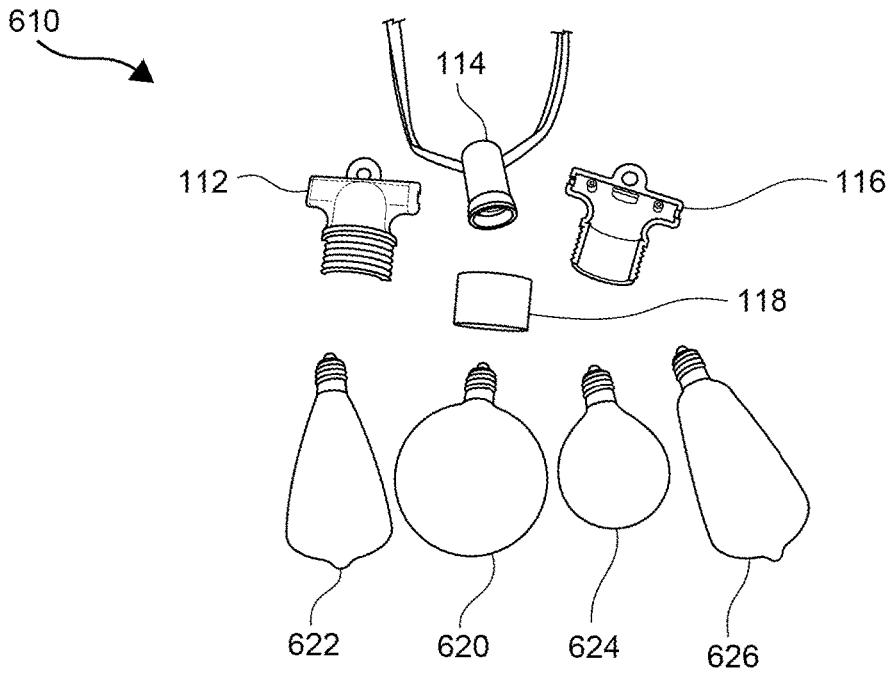
FIG. 17 is an exploded view of the light component of FIG. 15 with interchangeable light elements.

FIG. 17 shows an exploded view of light component 610 with interchangeable light elements 620, 622, 624, and 626. Light elements 620, 622, 624, and 626 have different shapes and types of outer lampshade layers. Light elements 620, 622, 624, and 626 can also have different types of light sources (e.g., LED, incandescent, 60 watt, 100 watt, etc.). However, light elements 620, 622, 624, and 626 have a similar threaded end for electrically and removably coupling with the threaded cavity of electrical socket 114.

Figure 18:
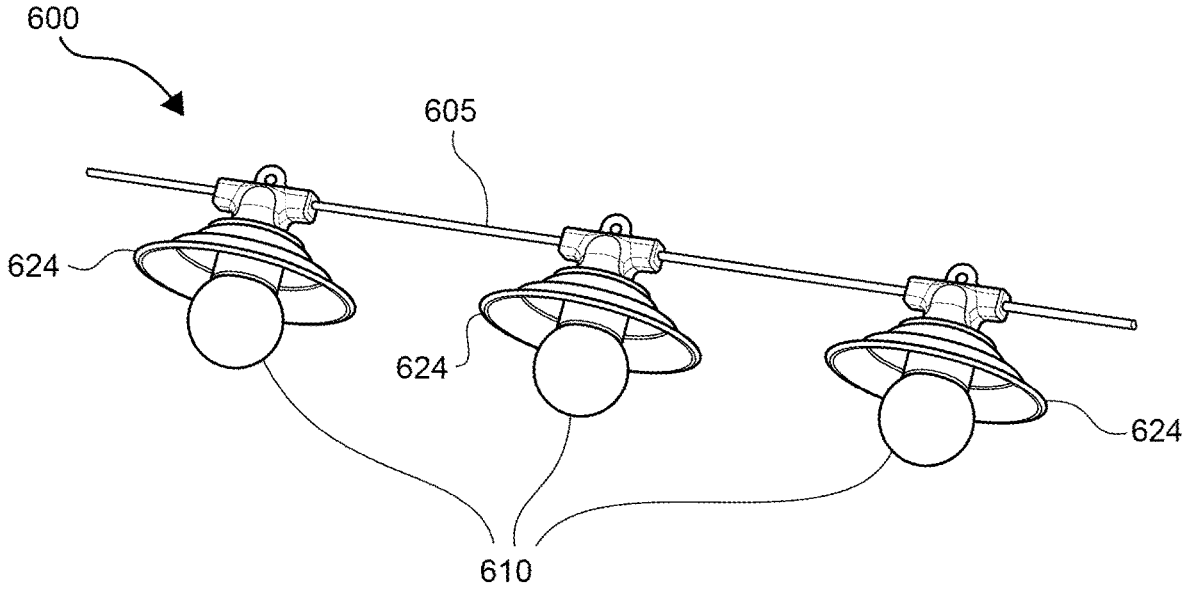
FIG. 18 is a perspective view of another embodiment of a string light assembly with a second lampshade.

FIG. 18 shows string light assembly 600 with a secondary lampshade 624 removably attached to each light component 610.

Figure 19:
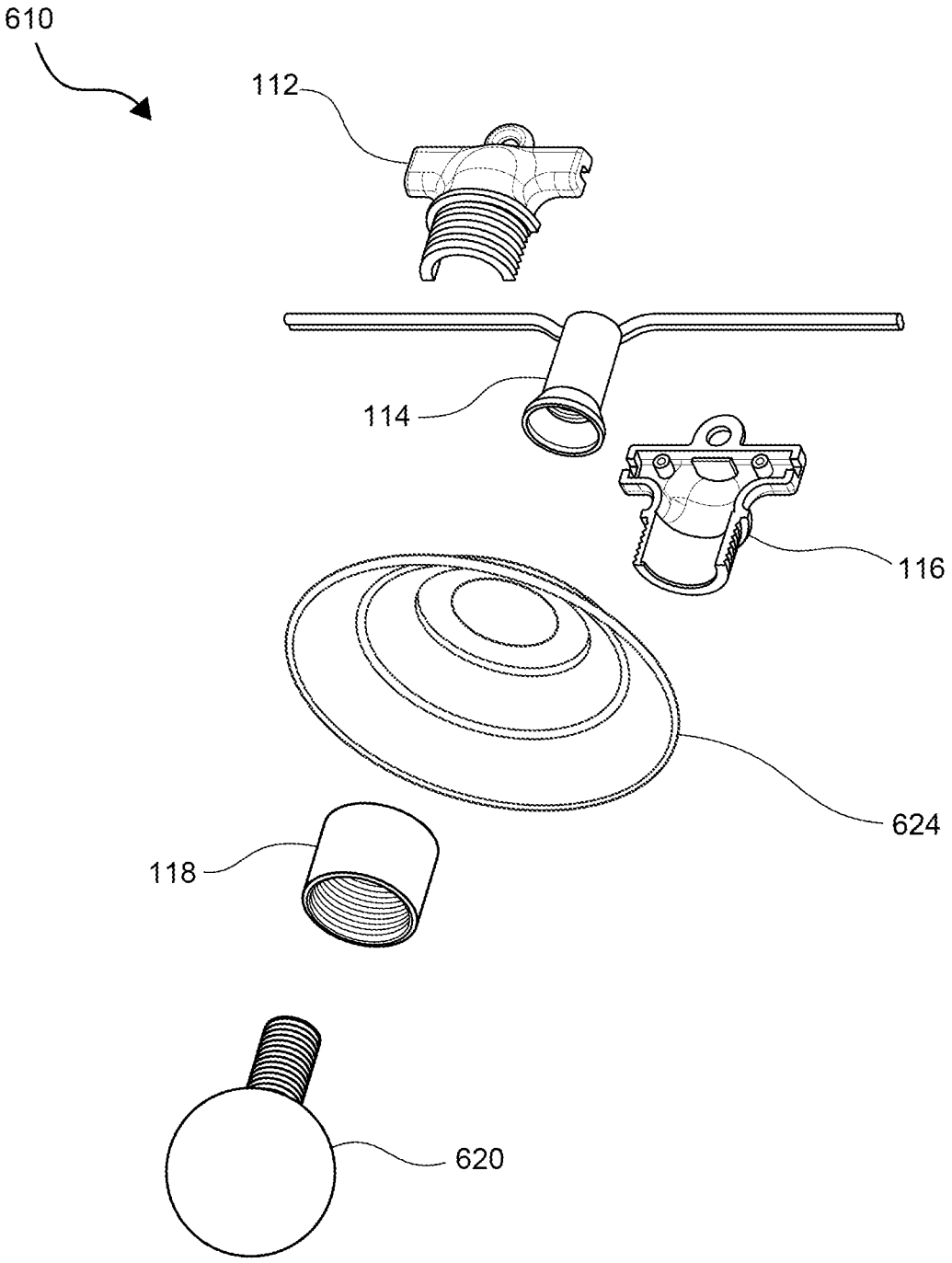
FIG. 19 is an exploded view of the light component of FIG. 18 with a second lampshade.

FIG. 19 shows an exploded view of light component 610 with the secondary lampshade 624. The parts shown in FIG. 19 are the same as FIG. 16 except for the addition of the secondary lampshade 624. Lampshade 624 removably couples with the first socket cover 112 and the second socket cover 116 by placing the distal end of the t-shaped body through the opening of lampshade 624 and then screwing collar 118 onto the external threads of first socket cover 112 and the second socket cover 116. The size of the opening of lampshade 624 is less than an outer width or diameter of the housing (e.g., rim or flange) and the collar 118. In this manner, collar 118 can be used to secure lampshade 624 to the housing formed by first socket cover 112 and second socket cover 116.

It is contemplated that lampshade 624 can be made of plastic, metal, a composite, or any material suitable for providing shading to a light element. It is also contemplated that lampshade 624 can be made in many different shapes to provide different styles (e.g., outdoor, indoor, modern, rustic, etc.) and can be interchangeable with different shapes and colors of lampshades to create a different style for the string light assembly.

The light component design described herein advantageously allows for different lampshades to be interchangeable to customize the look and feel of the string light assembly. Additionally, the light component design is easy to assemble due to a reduced number of parts. The design can also be used to imitate the effect of an E26 string light, but with the lower cost due to use of an LED bulb.

From a methods perspective, the inventive subject matter includes a method of assembling a light component comprising the steps of: (i) placing an electrical socket between, and inside, the interior space of a first socket cover and a second socket cover; (ii) fastening the first socket cover and second socket cover together, such as by ultrasonic welding, threading a screw from the first socket cover to the second socket cover, or placing and fastening a collar over the distal end of the first and second socket cover; and (iii) removably coupling a light element or light source to the electrical socket, such as by threading external screws on the light element or light source to internal threads in the cavity of the electrical socket. The method can also include the step of placing a secondary lampshade over the distal end of the first and second socket cover prior to placing the collar over the distal end, and then placing the collar on the distal end to secure the secondary lampshade.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the spirit of the amended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification refers to at least one of something selected from the group consisting of A, B, C . . . and N, the text should be interpreted as requiring only one element from the group, not A plus N, or B plus N, etc.

What is claimed is:

1. A light component of a string light assembly comprising:

a first cover and a second cover that couple together to form a housing having an interior space and a distal end;

an electrical socket having a pair of electrical wires, wherein the electrical socket and pair of electrical wires are sized and dimensioned to fit inside the interior space of the housing;

a collar sized and dimensioned to fit over an external surface of the distal end of the housing;

a first light element configured to electrically and removably couple with the electrical socket;

a first lampshade having a threaded end that mates with internal threads of the collar; and a secondary lampshade having an opening that fits over the external surface of the distal end of the housing, wherein the opening is smaller than an outer width or diameter of the collar.

2. The light component of claim 1, wherein the first light element comprises a light source surrounded by, and integrally formed with, an outer lampshade layer.

3. The light component of claim 2, further comprising a second light element configured to electrically and removably couple with the electrical socket.

4. The light component of claim 3, wherein the second light element comprises a second light source surrounded by, and integrally formed with, a second outer lampshade layer.

5. The light component of claim 4, wherein either (i) the second outer lampshade layer is a different size or type than the first outer lampshade layer, or (ii) the second light source is a different type than the first light source.

6. The light component of claim 1, wherein the external surface of the distal end of the housing has threads that are sized and dimensioned to mate with internal threads of the collar.

7. The light component of claim 1, wherein an internal surface of the collar has an annular flange sized and dimensioned to latch onto an annular groove on the external surface of the distal end of housing.

8. The light component of claim 1, wherein the first cover and second cover each comprise a threaded screw hole for receiving a screw.

9. The light component of claim 1, wherein the first cover and second cover are coupled by an ultrasonic weld.

10. A string light assembly comprising: a wired connection having a first end and a second end, wherein the first end comprises a first electrical connector configured to electrically couple with an electrical power supply and the second end optionally comprises a second electrical connector configured to electrically couple with another string light assembly; a plurality of light components extending from the wired connection at intervals located along a length of the wired connection; wherein each light component comprises: a first cover and a second cover that couple together to form a housing having an interior space; an electrical socket having a first electrical wire and a second electrical wire, wherein the electrical socket, first electrical wire, and second electrical wire are sized and dimensioned to fit inside the interior space of the housing; a collar sized and dimensioned to fit over an external surface of a distal end of the housing; a light element configured to electrically and removably couple with the electrical socket; a first lampshade having a threaded end that mates with internal threads of the collar; and a secondary lampshade having an opening that fits over the external surface of the distal end of the housing, wherein the opening is smaller than an outer width or diameter of the collar.

11. A method of assembling a light component comprising a first cover, a second cover, an electrical socket, a collar, a light element, and a secondary lampshade, the method comprising the steps of:

placing the electrical socket between, and inside, an interior space of the first cover and the second cover;

fastening the first cover and second cover together;

placing the collar over an external surface of a distal end of the first cover and second cover;

removably coupling the light element to the electrical socket; and placing an opening of the secondary lampshade over the external surface of the distal end of the first and second socket cover prior to placing the collar over the distal end.

12. The method of claim 11, wherein the first cover and second cover are fastened together by ultrasonic welding a seam between the first and second cover.

13. The method of claim 11, wherein the first cover and second cover are fastened together by threading a screw through a threaded hole in the first cover and the second cover.

14. The method of claim 11, wherein the first cover and second cover are fastened together by mating internal threads of the collar with external threads on the external surface of the distal end of the first and second cover, or by latching an annular flange on an internal surface of the collar with an annular groove on the external surface of the distal end of the first cover and second cover.

15. The method of claim 11, wherein the step of removably coupling the light element to the electrical socket comprises mating external threads on an end of the light element with internal threads inside a cavity of the electrical socket.

16. The method of claim 11, wherein the step of placing the collar over the external surface of the distal end secures the secondary lampshade to the first and second cover.

* * * * *